United States Patent [19]

Lester

[11] 4,203,536

[45] May 20, 1980

[54] DISPENSING CLOSURE FOR A SQUEEZABLE CONTAINER

[76] Inventor: William M. Lester, 8 Brayton Rd., Livingston, N.J. 07039

[21] Appl. No.: 941,142

[22] Filed: Sep. 11, 1978

[51] Int. Cl.[2] ..... B67D 3/00; B65D 83/14

[52] U.S. Cl. ..... 222/495; 222/501; 222/549; 251/82

[58] Field of Search ..... 251/82; 137/533; 222/492, 493, 500, 501, 520, 524, 525, 549, 563, 495, 496, 497

[56] References Cited

U.S. PATENT DOCUMENTS

| | | | |
|---|---|---|---|
| 963,836 | 7/1910 | Varlie | 251/82 |
| 1,721,666 | 7/1929 | Lee | 222/497 |
| 3,165,242 | 1/1965 | Jackson | 222/495 |
| 3,490,658 | 11/1970 | Schwartzman | 222/496 X |
| 3,817,284 | 6/1974 | Daugherty | 251/82 X |
| 3,887,116 | 6/1975 | Ishikawa et al. | 222/520 |

FOREIGN PATENT DOCUMENTS

| | | | |
|---|---|---|---|
| 2364168 | 4/1978 | France | 222/495 |
| 84097 | 8/1935 | Switzerland | 222/520 |

*Primary Examiner*—David A. Scherbel

[57] ABSTRACT

A housing containing annular tapered valve seat and mating valve secure the valve in fluid communication with the container interior. Fluid in the container under pressure displaces the valve from its seat, flows through the interface between the valve and seat and is discharged to the ambient through a fluid passage coupled to the interface. A shoulder in the housing engages a shoulder on the valve for limiting the displacement of the valve to a value sufficiently small to retain fluid in the interface in the absence of pressure above ambient in the container. The fluid in the interface acts effectively as a seal to ambient air so that a negative pressure in the container results in ambient air pressure forcing the valve to its closed position.

9 Claims, 6 Drawing Figures

DISPENSING CLOSURE FOR A SQUEEZABLE CONTAINER

Figure 1:
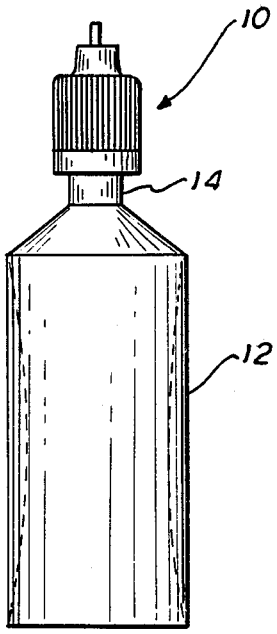

The present invention relates to dispensing closures for squeezable containers.

Automatic dispensing closure valves for squeezable containers include valves which open in response to greater than ambient pressure inside the container. The pressure forces the fluid in the container through the valve then through a discharge orifice to the ambient. To close the valve the valve either has to be manually returned to the closed position or, in some configurations, automatically returns to the closed position. In the latter valves, various spring devices are provided which are placed under spring bias pressure when the valve opens. Upon reduction of pressure in the container to ambient or less, the spring bias pressure closes the valve. While it is more desirable to provide automatic closure of the valve the additional spring elements add to the cost and complexity of the apparatus.

In a closure embodying the present invention for a squeezable resilient container which during squeezing exhibits an interior pressure greater than atmospheric and during its return to the stable unsqueezed condition exhibits an interior pressure less than atmospheric, a valve is provided which includes first means in fluid communication with the interior and ambient responsive to the pressure differential produced by the greater interior pressure for placing the valve in the open valve condition and second means in fluid communication with the interior and ambient responsive solely to the pressure differential created by the less than atmospheric pressure in the container for placing the valve in the closed valve condition.

IN THE DRAWING

Figure 2:
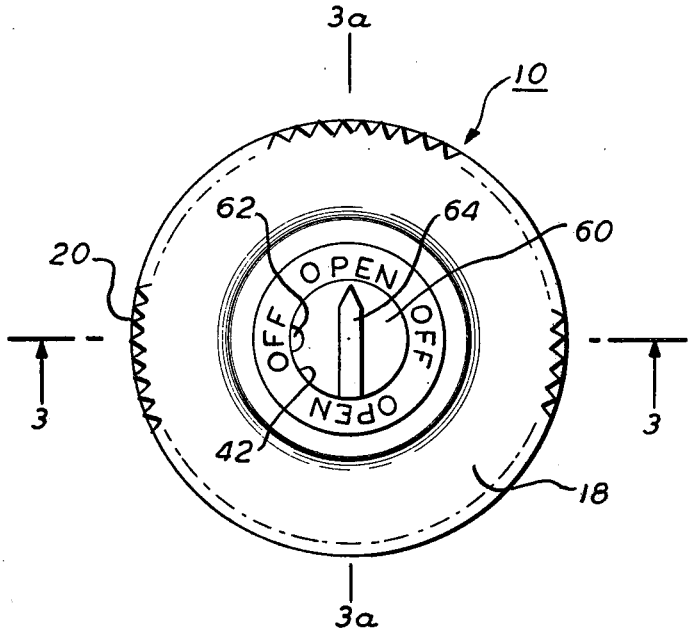
Figure 3:
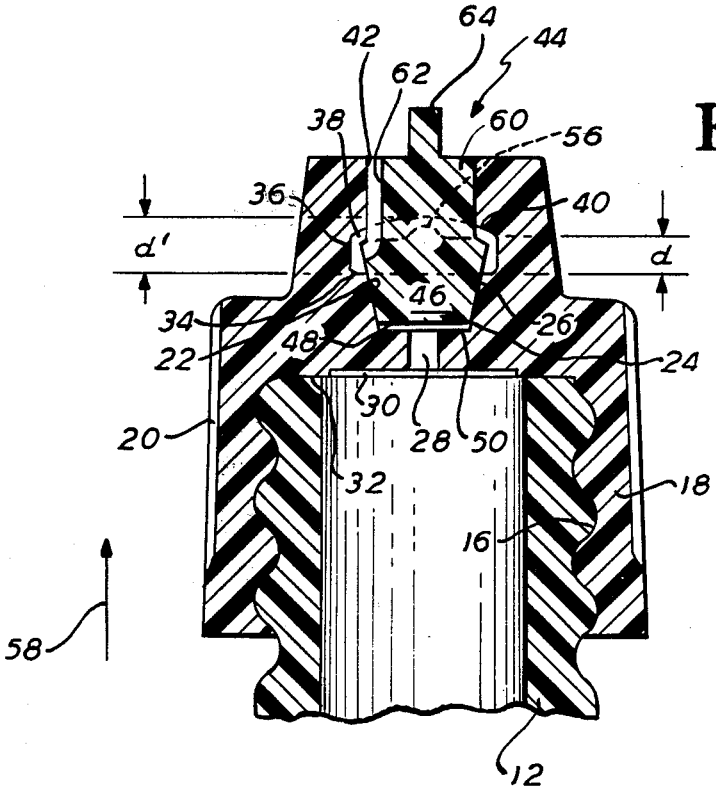
Figure 4:
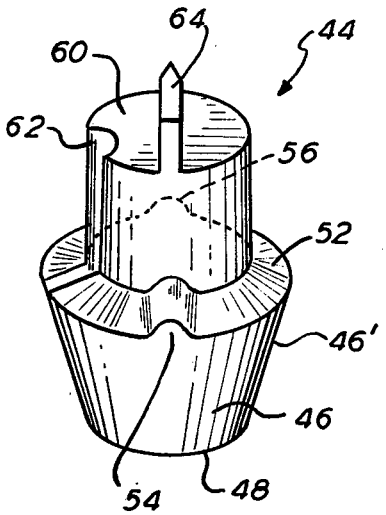
Figure 5:
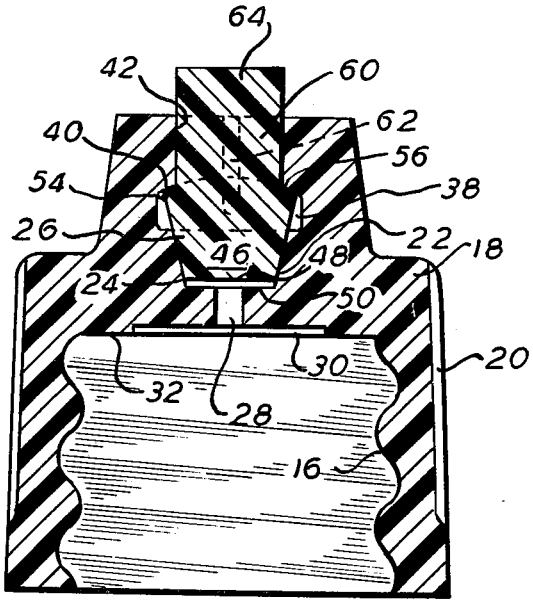
Figure 6:
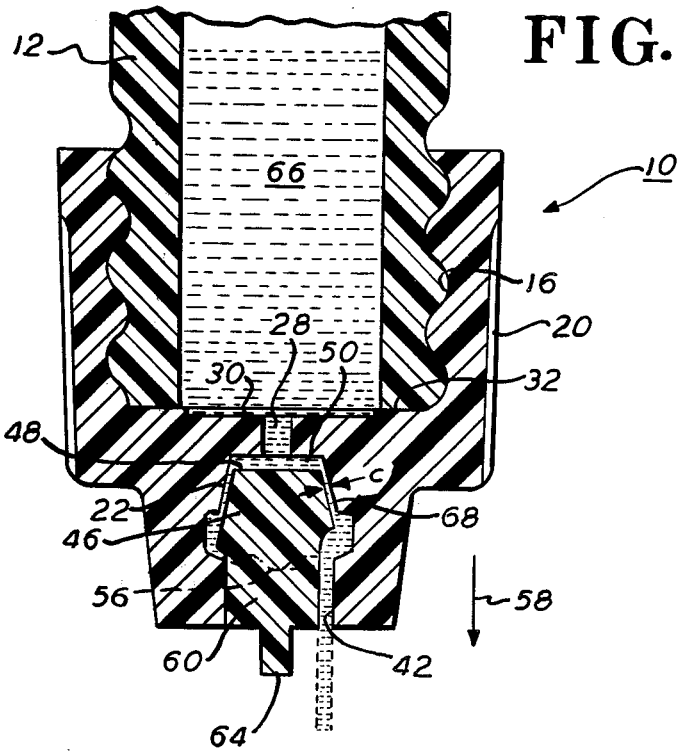

FIG. 1 is an elevation view of a closure embodying the present invention mounted on a squeezable container, FIG. 2 is a plan view of the closure of FIG. 1, FIG. 3 is a sectional view of the closure of FIG. 2 taken along Lines 3—3 showing the valve in the unlocked closed valve position, FIG. 4 is a perspective view of the valve, stem and discharge orifice of the closure of FIGS. 1 and 2, FIG. 5 is a sectional view of the closure similar to the view of FIG. 3 but with the valve in the closed and locked position, and FIG. 6 is a sectional view of the closure and container in the inverted position dispensing a fluid from the container.

In FIG. 1, the closure 10 embodying the present invention is illustrated as being useable with a plastic "squeeze" container 12 for various fluids, including liquids and pastes and the like. By depressing the container 12 at the sides, the container depresses or "squeezes" as shown dashed. The sides being resilient return to their original state (solid) when released. The squeezed condition increases the pressure in the container above ambient and forces the contents from the container through the closure as will be described. The closure has a lock state to prevent the contents of the container from discharging unintentionally in case of accidental squeezing as might occur during transit.

Container 12 has a threaded throat 14 on which the closure 10 is mounted via internal threads 16, FIG. 3, formed in housing 18. The housing external to threads

16 has serrations 20 to aid the user to mount and unmount the closure on the container. Any other fastening devices may be used instead of threads as may be convenient for a particular implementation. Housing 18 may be formed of any suitable material such as, for example, thermoplastics.

Internal to housing 18 is a tapered valve seat 22. Seat 22 has a frustro-conical shape with its smallest diameter 24 closest to container 12 and its largest diameter 26 furtherest from container 12. Seat 22 tapers outwardly and upwardly from diameter 24 to diameter 26. The slope of the seat surface is about 10 degrees with the vertical (top to bottom in the drawing). This angle is not critical and can vary somewhat from this range which is given by way of example. Seat 22 surrounds and forms the side wall of a hollow cavity in housing 18.

Conduit 28 is centrally positioned within the circumference of diameter 24 and provides fluid communication between the cavity surrounded by seat 22 and the container 12 interior. A circular recess 30 which is disc-like in shape is formed in the lower interior surface of housing 18 to form a raised annular washer-like lip 32. Lip 32 engages the lip of the container 12 for sealing the container to housing 18. A gasket ring may also be used to seal the lip of the container to housing 18.

The upper edge of seat 22 terminates at bottom circular wall 34 which joins cylindrical upstanding side wall 36 to form an interior chamber 38 in housing 18 open to the cavity surrounded by seat 22. Chamber 38 has an upper ring-like ceiling wall 40. Wall 40 has a sloped shape for providing locking action as will be described. Wall 40 along lines 3—3, FIG. 2, is spaced a distance d (the height of wall 36) from bottom wall 34. Wall 40 along lines 3*a*—3*a*, FIG. 2, is spaced a distance d' (next to wall 36) from bottom wall 34, lines 3*a*—3*a* being 90 degrees from lines 3—3. Wall 40 tapers smoothly from distance d to distance d' in a continuous smooth downwardly facing shoulder. This ceiling wall 40 also slopes upwardly and radially inwardly from its outer circumference. Distance d' is greater than distance d as will be explained.

A cylindrical longitudinal stem guide aperture 42 is formed in housing 18 open to chamber 38 at its lower end and to the ambient at its upper end. Aperture 42 is coaxial with the seat 22 and conduit 38 at the intersection of lines 3—3 and 3*a*—3*a* when connected.

A valve, stem and knob assembly 44 is mounted in seat 22, chamber 38 and aperture 42. Assembly 44 is best seen in FIG. 4 and includes a tapered valve 46 which seats in and mates with seat 22. When fully seated in seat 22 the valve is closed and no fluid can pass in the interface between the valve 46 and seat 22. The bottom surface 48 of valve 46 is flat and is spaced from the housing lip 50 surrounding conduit 28 at the base of seat 22 when the valve is closed. The tapered surface 46' of valve 46 terminates at its upper extremity at shoulder 52. Shoulder 52 tapers downwardly and radially outwardly from its more central portion to the tapered valve surface 46'. The taper of shoulder 52 is similar to the taper in ceiling wall 40 of chamber 38 which tapers in complementary fashion.

Two radially extending ridges 54 and 56 are on shoulder 52 at diametrically opposite sides of valve 46. These ridges are molded integral with valve 46 in this example. When valve 46 is seated in seat 22 in the closed valve condition and the ridges 54 and 56 are aligned along lines 3*a*—3*a* there is a clearance distance between the ridges and ceiling wall 40 which permits the valve to displace in the direction of arrow 58. That is, wall 40 acts as a stop for valve 46 limiting its displacement from seat 22 to a certain value whose importance will be explained later. When the valve is rotated 90 degrees so that the ridges are aligned with imaginary lines 3—3, FIG. 2, the ridges 54,56 engage ceiling wall 40. Distance d is made that value such that there is a slight interference fit between ridges 54 and 56 and ceiling wall 40 when at this angular position and the valve is fully seated. Since the valve and ridges and housing are made of a somewhat pliable material such as polypropelene or polyethelene, the slight interference fit forces and locks the valve 46 in the closed valve position and excess pressure from within the container will not accidentally displace the valve 46 ajar from the closed valve position. It does not matter in which direction valve 46 is rotated. When ridges 54,56 are in line with lines 3*a*—3*a* the valve may open, and with lines 3—3, the valve is locked closed.

Cylindrical stem 60 is integral with valve 46 and extends centrally upwardly from valve 46. Stem 60 fits closely within aperture 42 an amount sufficient to prevent fluid from seeping between aperture 42 and stem 46 but not so close as to prevent stem 60 from sliding in aperture 42. Stem 60 serves as a guide for valve 46 to ensure that valve 46 seats properly in seat 22.

A longitudinal fluid discharge channel 62 is formed in a side of stem 60 and extends through shoulder 52 and terminates in the tapered side wall 46' of valve 46. As seen in FIG. 3 channel 62 thus terminates at one end in chamber 38 and at the other end in the ambient. Any fluid under pressure in chamber 38 exits the chamber to the ambient between the channel 62 and the aperture 42 side wall.

A flat knob 64 extends from stem 60 and is in the form of an arrow to indicate the locked (off) or unlocked (open) position of the valve 46 (FIG. 2). Rotation of the knob 64 positions the valve in the desired locked or unlocked position. In FIG. 2, the knob 64 indicates the valve is in the unlocked (open) position of FIG. 3.

FIG. 5 shows the valve rotated 90 degrees from the position of FIGS. 2 and 3. In this position the valve 46 is locked in the closed valve position. Ridges 54 and 56 abut ceiling wall 40 and force valve 46 tightly into seat 22. Pressure within container 12 can not open the valve.

In FIG. 6, the inverted assembly is discharging a fluid 66, container 12 being squeezed to increase the internal pressure above ambient. The fluid flows through conduit 28, impinges against valve 46 bottom surface 48, forcing the valve open in the direction of arrow 58. Fluid flows into the interface 68 between seat 22 and the tapered valve surface of valve 46. Because the conduit is centrally positioned and of sufficient flow capacity for the particular fluid, fluid enters into the interface 68 in an annular flow completely surrounding the tapered surface of valve 46 and filling the entire interface 68. This occurs because the clearance C between seat 22 and valve 46 is sufficiently small with respect to the volume of fluid flowing, that is, the internal pressure at the bottom 48 of valve 46 is sufficiently high with respect to the entire flow area at the interface 68, such that fluid tends to enter the entire circumferential area of the interface as the fluid emerges from conduit 28. These relationships can be readily determined empirically.

The distance d' (FIG. 3) is chosen to provide sufficient clearance space for ridges 54 and 56 so that clearance C (FIG. 6) does not exceed a certain value. That value is one which permits interface 68 to be filled and remain filled in an annular continuous ring around valve surface 46' during the squeeze and subsequent release actions.

It is to be understood that the clearance C is also a function of the fluid viscosity. A more viscous fluid, for example, heavy oil, flows less readily than a less viscous fluid such as water. Thus the interface 68 flow area should be made greater for more viscous fluids than less viscous fluids to form the fluid sealing action. The interface 68 will remain sealed longer (with the container interior pressure at ambient) with a more viscous fluid than with a less viscous fluid for a given clearance. The time the fluid should remain in the interface as a seal is a matter of a few seconds until the valve 46 closes as the container pressure becomes less than ambient. The amount of fluid in the interface is not critical as long as the fluid forms a continuous annular ring about valve 46 so that ambient air does not immediately return to the container interior without first closing valve 46.

This fluid ring acts effectively as a seal to ambient air attempting to return to the container 12 interior via the interface 68. Since air can not easily return via this route due to the presence of the fluid in the interface, the greater pressure forces the valve 46 against seat 22, closing the valve automatically and without any spring bias devices. Of course, after the valve 46 is seated, the higher ambient pressure may tend to seep air through the closed interface 68 to equalize the pressure in the container 12 interior with the ambient since the seal may not be a perfect seal. This is acceptable. The valve will be effectively closed and will remain in that position until the container is again squeezed. To prevent accidental discharge it can be locked, but that is not essential to placing the valve in the closed position. By way of example, for a mean seat diameter of 7/16 inches and a fluid viscosity of about same as S.A.E. 40 oil, the clearance C can have a value of about 1/64 inches.

Thus wall 40 acts as a displacement limiting device for valve 46. This action ensures automatic closure of the valve upon dissipation of back pressure (greater than ambient) in conduit 28 and container interior and upon creation of a negative pressure (less than ambient) in conduit 28. This pressure shift results from the natural return of container 12 from the squeezed (dashed-FIG. 1) condition to the stable condition (solid-FIG. 1).

What is claimed is:

1. A closure for dispensing a fluid stored in a squeezable resilient container comprising:

a housing, means for securing the housing in fluid communication with the container interior, an annular tapered valve seat in said housing having a surface at a first smaller diameter which tapers toward a larger second diameter, said smaller diameter being closest to said container interior, a tapered annular valve member having a bottom surface and a tapered side surface, said side surface complementing said valve seat for providing a substantially fluid tight seal when seated in the closed valve position and for providing a fluid passage at the interface between said member side surface and said seat when in the open valve position, a side of said member opposite said bottom surface being coupled to the ambient, said bottom surface and said interface being positioned in fluid communication with said stored fluid so that fluid forced against said bottom surface displaces said member to the open valve position and said fluid enters into said interface in an annular continuous ring, fluid discharge conduit means in fluid communication with and between said interface and the ambient, and valve member displacement limiting means connected to said housing for limiting the distance said member is permitted to displace from the closed valve position to the open valve position to provide a maximum clearance between said side surface and said seat at that value at which fluid in said interface tends to effectively seal said interface from ambient air when the container interior pressure is less than ambient pressure such that the pressure differential is sufficient to force said valve member to its closed valve position, said member having a shoulder, said housing having a chamber adjacent said larger diameter, said shoulder being positioned within said chamber, said chamber having an upper wall which abuts said shoulder when said member is displaced to the open valve position for forming said displacement limiting means.

2. The closure of claim 1 wherein said housing has a guide aperture aligned with said seat in a direction parallel to a line connecting the centers of said diameters, said closure further including guide means extending from said member into said guide aperture.

3. The closure of claim 2 wherein said conduit means is disposed between said guide means and said aperture.

4. The closure of claim 1 wherein said member is rotatably mounted in said seat, said upper wall is spaced a first distance from said larger diameter at one annular location an amount sufficient to force said member to the closed position when said shoulder is at said one location and a second distance greater than said first distance at a second annular location an amount sufficient to permit said valve member to displace to said open valve position when said shoulder is at said second annular location.

5. A fluid dispensing closure for a squeezable resilient container which after squeezing tends to return to a normal stable condition creating a pressure lower than atmospheric within the container interior comprising:

a housing, means for securing the housing to said container in fluid communication with the container interior, valve means including a tapered valve member and a tapered mating valve seat in said housing having open and closed valve positions in fluid communication with said interior, said member being responsive to a pressure greater than atmospheric in said container for displacing to the open valve position permitting fluid in said container to enter the interface between said member and said seat in an annular ring, valve member displacement limiting means connected to said housing for limiting the displacement of said member from the closed to open valve positions to provide a maximum clearance between said member and said seat at that value at which fluid in said interface tends to effectively prevent ambient air from passing through said interface to said interior during the return of the container to the stable condition, the pressure differential during said return being sufficient to force said valve member to its closed valve position, fluid discharge means coupled to said housing for dispensing fluid from said interface to the ambient during said squeezing, and a stem extending from said member in said housing to the ambient atmosphere, said stem including means for rotating said stem and said member, said stem and member and said housing including valve locking means for locking said member in the closed valve position in one angular orientation and for releasing said member in a second different angular orientation.

6. The closure of claim 5 wherein said closure further includes an orifice in fluid communication with said interior and said tapered valve seat for distributing said fluid during said squeezing against said valve member and into said interface.

7. The closure of claim 5, wherein said discharge means includes a groove in said valve member and said stem in fluid communication with said interface for receiving fluid to be discharged to said atmosphere.

8. The closure of claim 7 wherein said housing includes a chamber on one side of said member and an orifice on the other side of said member, said orifice being in fluid communication with said interior and said interface, said chamber being in fluid communication with said discharge means and said interface, said chamber having a sloping upper wall which at one angular position is closer to said member than at a second different angular position, said member including an upstanding ridge which engages said upper wall in said one position to force and lock the member in the closed valve position and which engages and abuts said upper wall in said second position when said member is in the open valve position.

9. A closure for a squeezable container comprising:

a housing, means for securing the housing to said container, a tapered annular valve seat in said housing with its smaller circumferential dimension closest to said container, an annular valve member mounted for displacement within and mating with said seat for closing the aperture formed by said seat in one axial position and opening the aperture via the interface between the member and the seat in a second axial position, fluid conduit means in fluid communication with said interface and the container interior, a chamber in said housing into which the greater circumferential dimension of said valve member can enter, an annular upstanding stem connected to said member at said greater dimension, said stem having a transverse dimension less than the diameter of said greater dimension to form a shoulder on said member facing in a direction away from said seat, and a conduit in said stem extending into said member into said chamber for providing fluid communication between the ambient and said chamber, said chamber having an upper wall positioned to engage said shoulder when axially displaced from said seat to limit the displacement of said member away from said seat to an amount sufficiently great to provide an interface clearance between said chamber and said seat which permits fluid from said container to flow through said interface and sufficiently small to permit said fluid when not under pressure and in said interface to form a continuous annular fluid volume in contact and around said seat and said member to form a fluid seal therebetween when the member is in the open valve position whereby ambient pressure when greater than the interior pressure forces said member axially into said seat to the closed valve position.

* * * * *